US005176277A

United States Patent [19]

Schuermann

[11] Patent Number: 5,176,277

[45] Date of Patent: Jan. 5, 1993

[54] END CLOSURE HAVING PUSH OPEN LID

[75] Inventor: Dave Schuermann, Wassau, Wis.

[73] Assignee: Specialty Packaging Group Inc., Wausau, Wis.

[21] Appl. No.: 840,087

[22] Filed: Feb. 24, 1992

[51] Int. Cl.[5] ..... B65D 51/18

[52] U.S. Cl. ..... 220/253; 220/258; 220/268; 220/335; 220/379; 222/153; 222/541; 222/548

[58] Field of Search ..... 220/253, 254, 258, 259, 220/268, 335, 336, 379, 744; 222/153, 541, 548

[56] References Cited

U.S. PATENT DOCUMENTS

| | | | |
|---|---|---|---|
| 4,265,367 | 5/1981 | Vogt | 220/269 |
| 4,516,689 | 5/1985 | Barker | 220/335 |
| 4,795,065 | 1/1989 | Ashizawa et al. | 222/541 |
| 4,969,572 | 11/1990 | vanKerkhoven et al. | 220/253 |
| 5,085,331 | 2/1982 | Groya et al. | 215/245 |

*Primary Examiner*—Stephen Marcus
*Assistant Examiner*—Nova Stucker

[57] ABSTRACT

An end closure for a container having a substantially planar first lid portion including an engaging element for engaging an upper rim of a container to be closed, a second substantially planar lid portion rotatably mounted to an upper surface of the first lid portion, the second lid portion having an opening defined therethrough, and an openable lid portion defined in the first lid portion. The openable lid portion includes a flexible hinge extending along first and second edge portions thereof and a frangible coupling extending along the remaining edges thereof including an edge segment which extends between and interconnects the first and second edge portions of the flexible hinge. A bottom surface of the first lid portion includes an engaging member for engaging an inner free edge of the openable lid portion defined by the frangible edge segment, so that when force is applied to the openable lid portion the frangible coupling is broken and the openable lid portion pivots about said first and second edge portions, the inner free edge engages the engaging member so as to retain said openable lid portion in an open disposition.

9 Claims, 7 Drawing Sheets

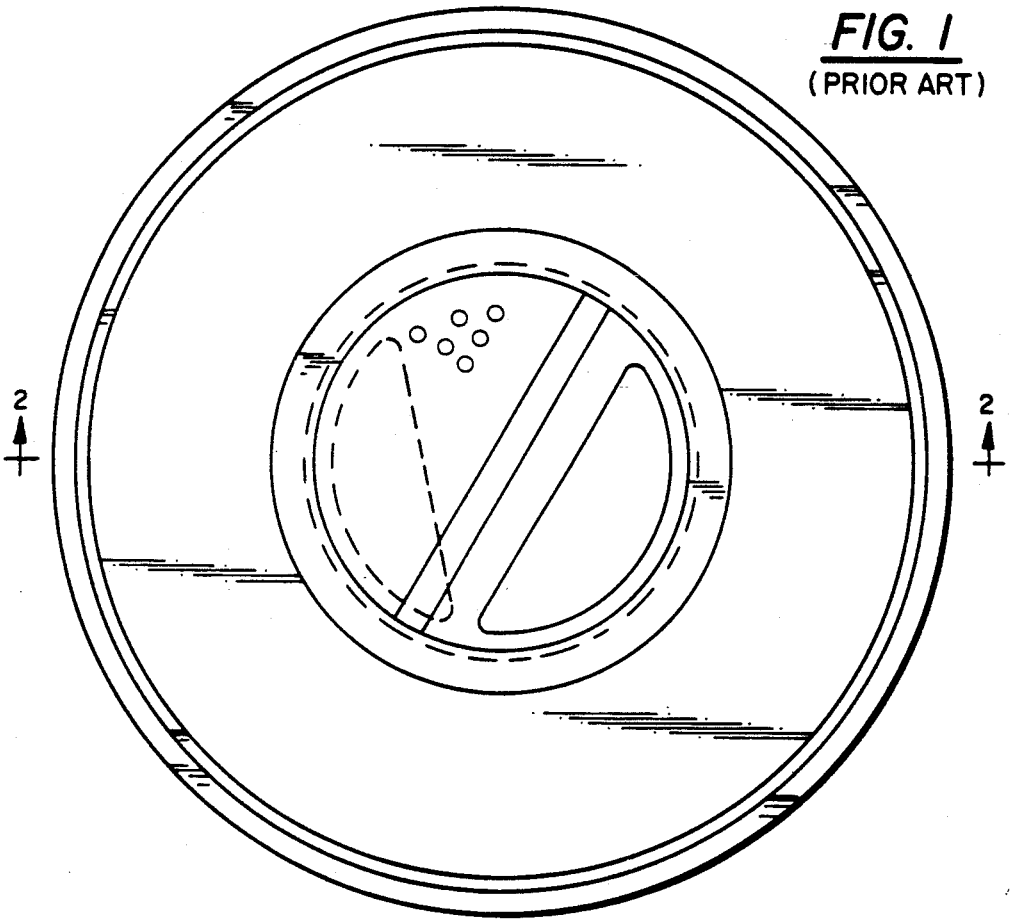
FIG. 1
(PRIOR ART)
FIG. 2
(PRIOR ART)
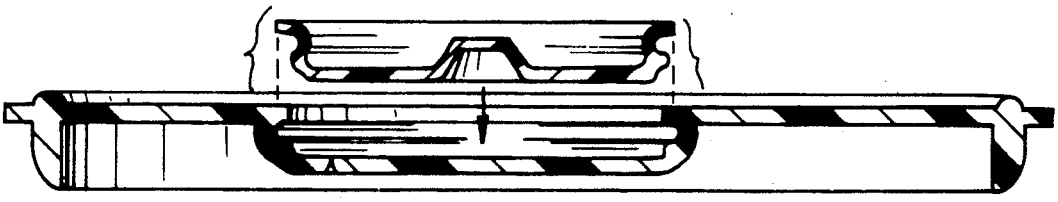

END CLOSURE HAVING PUSH OPEN LID

BACKGROUND OF THE INVENTION

1. Field of the Invention

The present invention relates to end closures for containers having a push open lid to provide access to the material within the container. More particularly, the present invention relates to an end closure having a push open lid portion which includes a member which cooperates with the lid portion to hold it in an open position.

2. Description of the Related Art

Granular products such as garden chemicals, grated cheese, coffee creamer, sugar and seasonings are typically packaged in containers with plastic closures having rotatable portion with one or more permanent openings therethrough which selectively provides access to an opening through a lower portion of the container. The opening through the lower portion is conventionally defined by an openable lid portion which is pushed toward the interior of the container thus breaking a seal between the openable lid portion and the remainder of the container closure. Once is the seal is broken, the openable lid portion bends about a living hinge permanently affixing the openable lid portion with the remainder of the container closure.

In these containers, the end closure initially seals the container prior to use, and when it is desired to open the container to access its contents, the rotatable portion of the lid can be rotated to align its largest opening with the openable lid portion. The openable lid portion is forced open by applying pressure thereto rupturing a frangible seal and causing the openable lid portion to bend about the hinge portion. The rotatable lid portion can again be rotated when it is desired to close the open lid so that the non-perforated portion of the rotatable lid portion covers the opening defined by the openable lid portion.

These containers provide the advantage of selectively accessing the contents thereof, while providing a means to close the same between uses. However, a disadvantage with such end closures is that the lid portion which was pushed down to access the material in the container tends to flex toward its initially closed position, due to the resilience of the hinge portion. This causes the pour opening to be restricted in size, particularly when the container is inverted to pour powdered substances therefrom. There are times when the lid portion can completely block the opening. Therefore, it would be desireable to provide a structure which retains the openable lid portion in an open position so as to not interfere with accessing the container contents.

FIGS. 1–7 show various prior attempts to develop end closures that exhibit a type of flat rotor that was rotatably retained on a base without use of a rivet type connector or a mechanism to hold a press-open lid in an open position.

FIGS. 1 and 2 correspond to a type of end closure suitable for placement at the end of a container to close the interior. The end closure is comprised of a base and a rotor retained on the base and in a central portion of the base which extends radially outwardly from the rotor. The periphery of the rotor is provided with a raised or upwardly extending edge that includes a substantially C-shaped cross-section annular ring that corresponds to a reverse C-shaped cross-sectional retaining groove formed within the base. The bottom surface of the rotor was essentially a flat planar surface and included a cut-out opening and shaker openings. The base included a smile-shaped knockout panel which would be opened by removing the entire piece of plastic. The base was also characterized by two levels, one corresponding to the surface that extended radially outwardly from the rotor, the other located beneath the rotor.

The end closure shown in FIGS. 3–5 is another version where the rotor, so marked, also had a flat planar bottom surface. The rotor was held in the base, as marked, by means of an annular extension projecting slightly beyond the peripheral edge of the rotor and a mating groove formed in the base. Both the annular extension and groove were radiused. The bottom surface of the rotor was spaced above the upper surface of the base against which it was positioned forming an open space therebetween in which debris or material from the container could collect. Also, the radiused extension/groove approach for retaining the rotor on the base was not sufficiently positive to hold the rotor in place and provide a suitable seal for the contents inside the container.

The end closure shown in FIGS. 6–7 is a closure that holds the openable lid open. The bottom plan view of the base in FIG. 6 and the cross-sectional view in FIG. 7 show the use of two tapered conical projections that extended downwardly from the bottom surface of the base toward the interior of the container on which the end closure would be used. The push open lid or flap is characterized by a straight hinge along its rear edge. Two straight sides diverge at oblique angles away from opposing ends of the hinge toward the front of the lid terminating at an arched front edge which joints the outer ends of those straight sides. The straight sides provide a special shape that will pass beyond the tapered projections to the position shown in FIG. 7 with minimum interference yet provide sufficient contact so that the projections hold the flap open. Depending upon the stiffness of the plastic of the hinge and the lid, the lid would need to be bent beyond 90° to move the lid beyond the projections in order to arrive at the position shown for the flap in FIG. 7. FIGS. 6*a* and 6*b* show top and bottom plan views of the rotor used for this end closure. The rotor was characterized by planar top and bottom surfaces, by a square cornered peripheral edge that mated with a radiused groove, as shown in FIG. 7, which was similar to the groove shown in FIG. 5 for retaining the rotor.

U.S. Pat. No. 4,969,572 discloses an end closure having a push open lid portion, wherein the underside of the openable lid portion includes members which cooperate with elements disposed on the underside of the end closure, for retaining the lid in an open disposition. A disadvantage of this closure is that the lid must be bent 90 degrees for it the lid member to engage the retaining elements. Also, this closure requires that the retaining elements and lid members be molded on the underside of the end closure and lid respectively, which increases the cost of the end closure.

SUMMARY OF THE INVENTION

An object of the present invention is to provide a container closure as described above which requires a single retaining element projecting from the bottom surface of the closure for retaining the pushed-open lid portion in a fully open disposition. These and other objects are realized in accordance with the present invention by providing an end closure for a container having a substantially planar first lid portion including an engaging element for engaging an upper rim of a container to be closed, a second substantially planar lid portion rotatably mounted to an upper surface of the first lid portion, the second lid portion having an opening defined therethrough, and an openable lid portion defined in the first lid portion. The openable lid portion includes a flexible hinge extending along first and second edge portions thereof and a frangible coupling extending along the remaining edges thereof including an edge segment which extends between and interconnects the first and second edge portions of the flexible hinge. A bottom surface of the first lid portion includes an engaging member for engaging an inner free edge of the openable lid portion defined by the frangible edge segment, so that when force is applied to the openable lid portion the frangible coupling is broken and the openable lid portion pivots about said first and second edge portions, the inner free edge engages the engaging member so as to retain said openable lid portion in an open disposition.

BRIEF DESCRIPTION OF THE DRAWINGS

FIG. 1 is a top plan view of a prior art end closure;

FIG. 2 is a cross-sectional view taken along line 2—2 in FIG. 1;

DETAILED DESCRIPTION OF THE PRESENTLY PREFERRED EXEMPLARY EMBODIMENT

Figure 4:
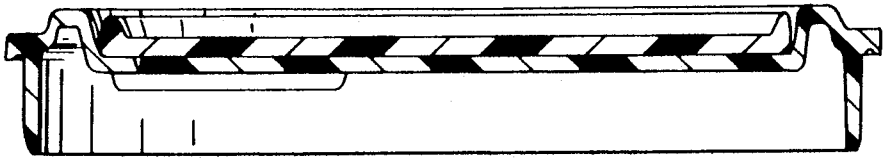
FIG. 4 (PRIOR ART)
FIG. 4 is a cross-sectional view taken along line 4—4 of FIG. 3.
Figure 5:
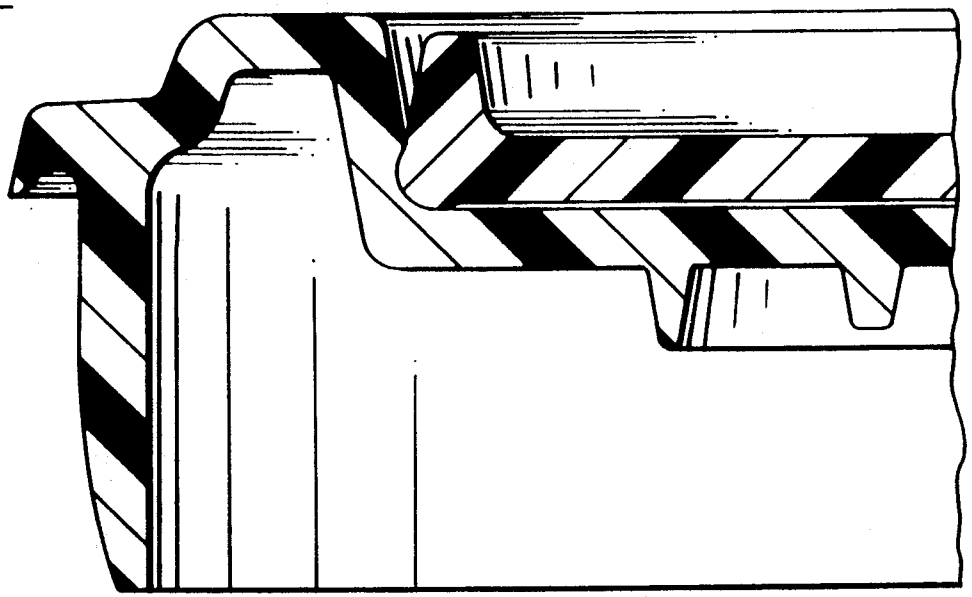
FIG. 5 (PRIOR ART)
FIG. 5 is an enlarged cross-sectional view of the peripheral edge of the closure of FIG. 4.
Figure 3:
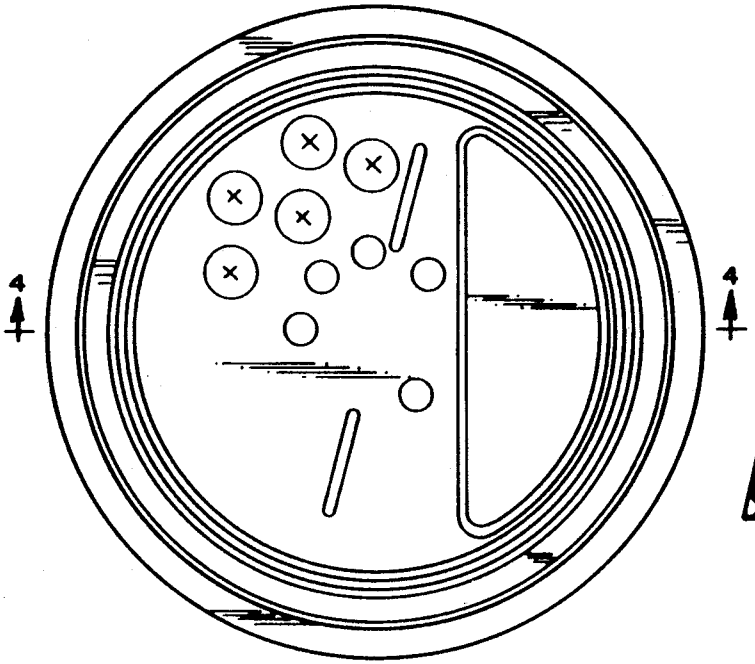
FIG. 3 (PRIOR ART)
FIG. 3 is a top plan view of another prior art end closure structure.
Figure 6:
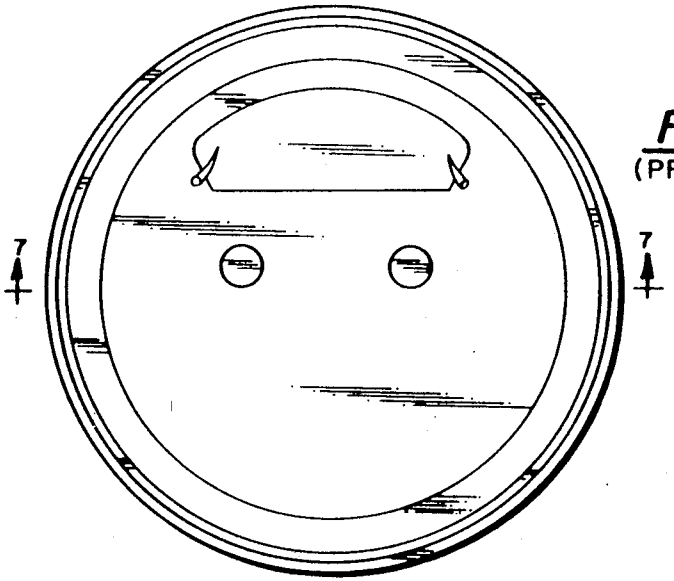
FIG. 6 (PRIOR ART)
FIG. 6 is a bottom plan view of a base from another prior art end closure structure.
Figure 6B:
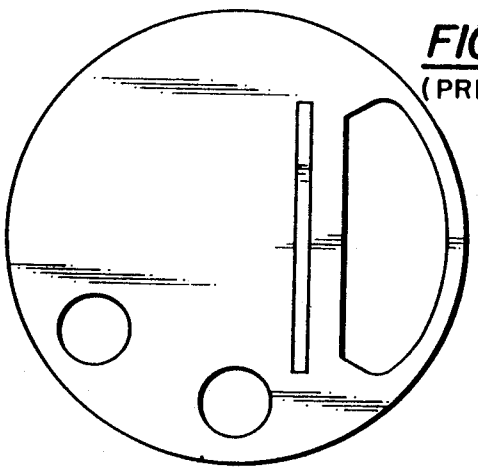
FIG. 6B (PRIOR ART)
FIG. 6B is a bottom plan view of the rotor shown in FIG. 6A.
Figure 6A:
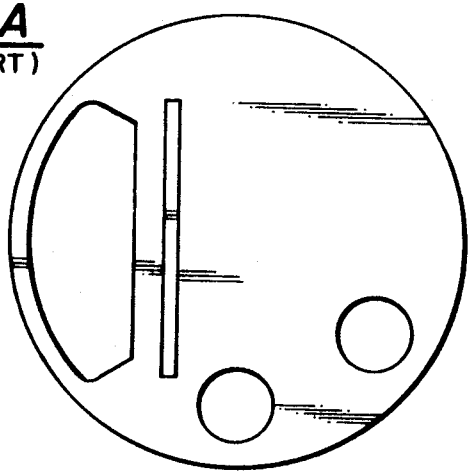
FIG. 6A (PRIOR ART)
FIG. 6A is a top plan view of a conventional rotor.
Figure 7:
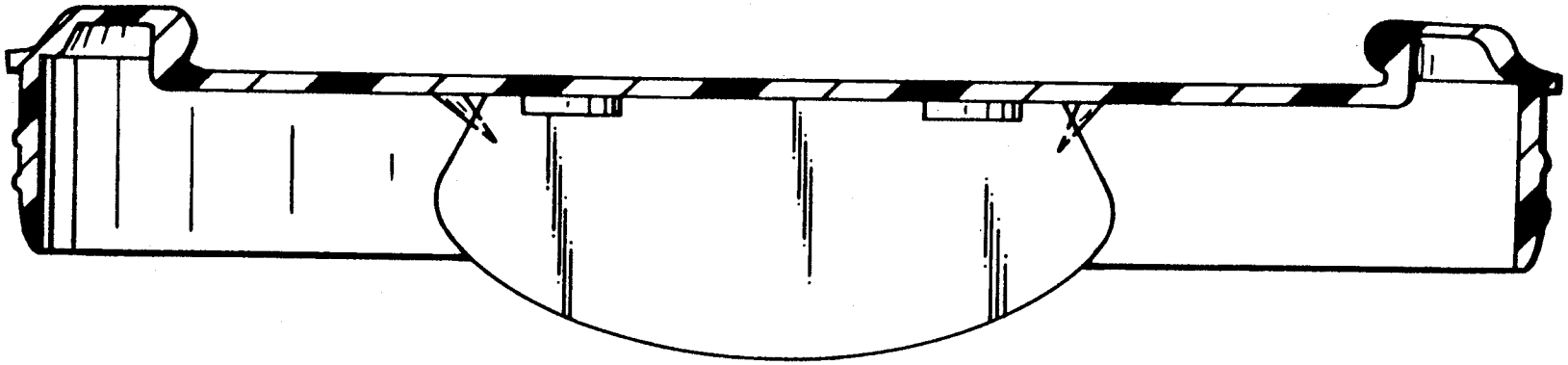
FIG. 7 (PRIOR ART)
FIG. 7 is a cross-sectional view taken along the line 7—7 of FIG. 6, with the openable lid portion held open.
Figure 8:
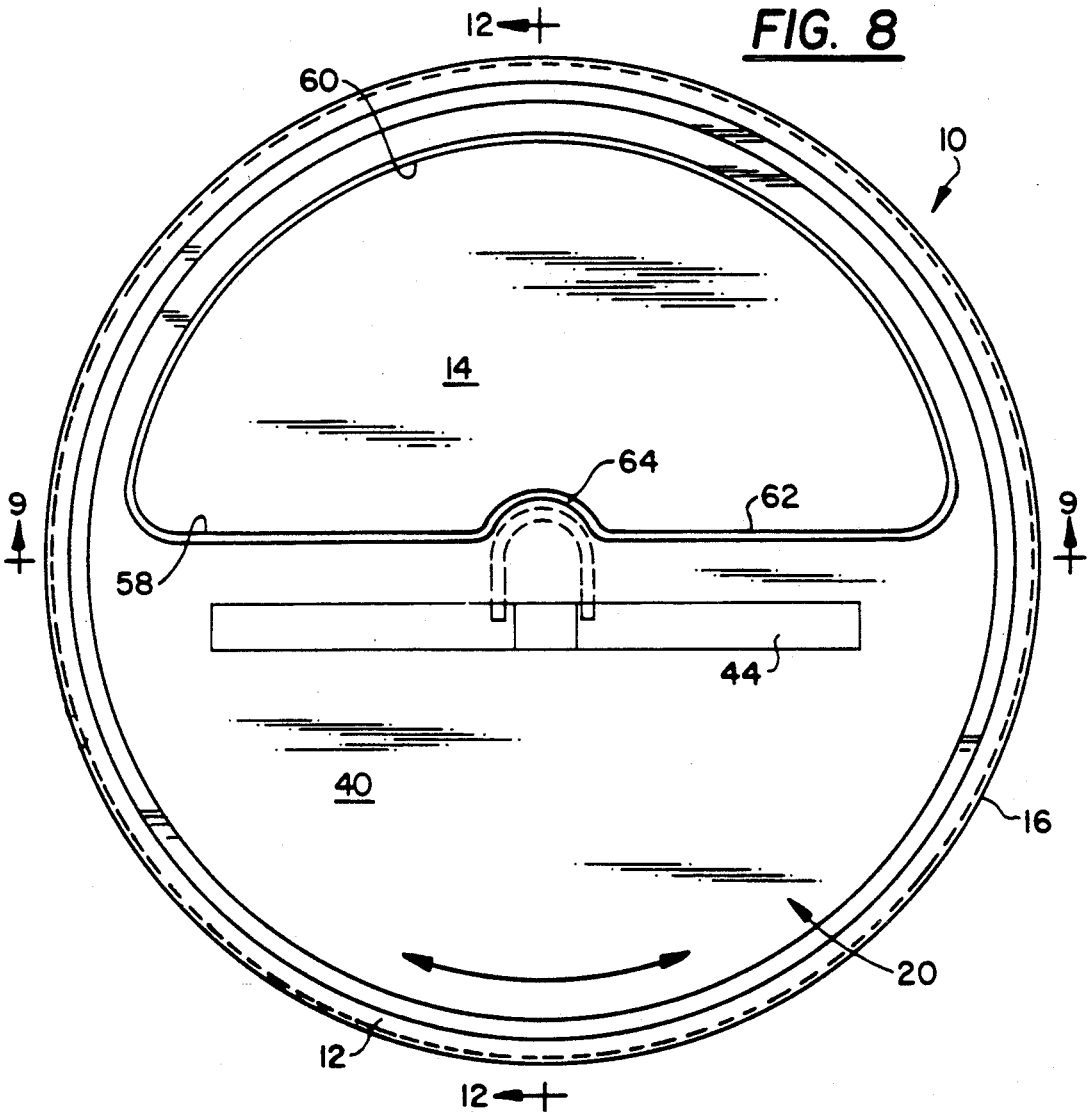
FIG. 8 is a top plan view of a closure lid provided in accordance with the present invention.
Figure 9:
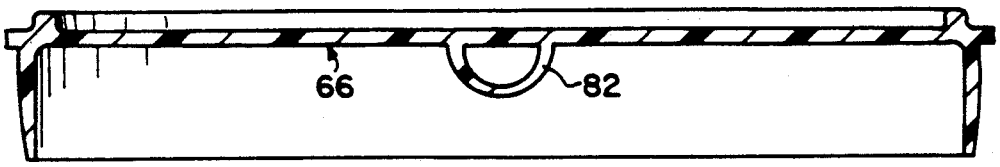
FIG. 9 is a cross-sectional taken along line 9—9 in FIG. 8, with the rotor removed.

Referring now to FIG. 8, a top plan view of an end closure 10 of the present invention is shown. The end closure 10 includes a bottom or base generally shown at 12, which includes a substantially planar central lid portion 14. When constructed and initially placed on a container (not shown), this portion 14 is integral; it includes no openings and does not include any opening into the interior to rotatably support a rotor structure. The base 12 includes a peripheral edge 16 for engaging a container top edge and for retaining the end closure on the same. The end closure further includes an upper substantially planar rotatable lid portion, generally indicated at 20, which is snap mounted to the base 12 so as to be rotatable relative thereto.

Figure 11:
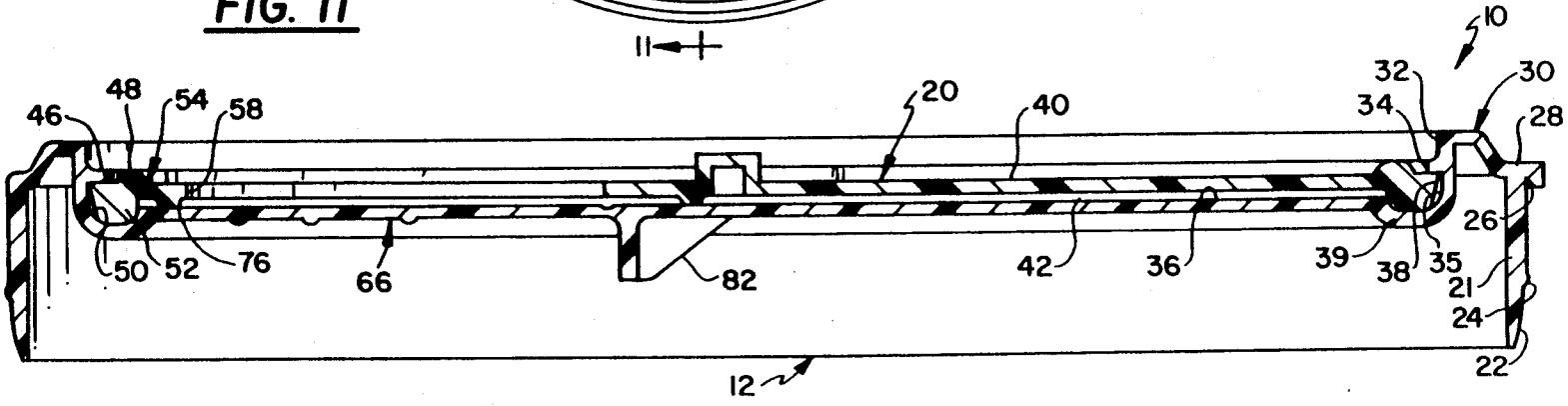
FIG. 11 is a cross-sectional view taken along the line 11-11 in FIG. 10.

With specific reference to FIG. 11, which is a cross-section of base 12 and rotor 20, the depending flange 21 is shown as having a tapered or beveled outer surface 22 that extends around the entire periphery of the base to help ease the closure into a container. A series of ribs, one of which is shown at 24, also extend around the depending flange 21 to assist in providing a proper interference fit and to provide additional surfaces for gluing or otherwise attaching the base to a container. The exterior sidewall terminates in an inverted V-shaped slot 26 into which the peripheral end of a container can fit or partially fit depending upon the sidewall thickness of the container. The top surface of the base, as shown in FIG. 11, includes an outer flat ledge 28 that also extends around the entire periphery of the upper surface of the end closure. This provides a surface that can be engaged by the end closure positioning apparatus to help force the closure into a container. In addition, this together with a raised rib structure, generally indicated at 30, provides a way of stacking individual ends as well as containers once the bottom is placed in the container. The front surface of the raised portion 30 is defined by a sloped wall 32 which terminates at a horizontally extending flange 34. Surface 36, as shown in FIG. 11, extends across the top of base 12 and includes no other openings other than that which will ultimately be defined when lid portion 66 is opened, as will become more apparent below.

The portion of the base 12 lying beneath flange 34 is comprised of a vertical wall 38 which flows into a radius groove 35 which then flows directly into the planar surface 36. In a closure for an eight ounce container the radius portions of groove 55 will preferably be about 0.0325 inches and a 0.032 inch flattened area can be provided in the center, as indicated at 39.

Turning to FIG. 8, the rotor 20 is provided with a top surface 40 while its bottom surface 42 is shown in FIG. 11. The rotor 20 is also provided with a handle member disposed on the top surface, such as shown at 44. Handle 44 can be in the form of two separate pieces as shown or one continuous piece. Other shaped handles could also be employed since all that is necessary is that some raised means be provided to turn the rotor 20 relative to the base 12 as indicated by the double arrow shown in FIG. 8.

FIG. 11 shows the inner fitting relationship between the rotor 20 and base 12. The marginal edge of rotor 20 has been designed with some specific purposes in mind. Concentrating first on the upper surface 40, the outer periphery includes a substantially flat ledge 46 and inboard from that is a rounded annular rib 48. The outer periphery is defined by a sloping sidewall 50 which has about a 10° slope with sidewall 50 then flowing into an annular ring 52 forming the exterior base of rotor 20. Elements 46-52 can be referred to collectively as a locking ring which is generally designated at 54. As shown in FIG. 11, this locking ring structure 54 fits within base 12 with flange 34 overlying the flat area 46 and with the radius portion 52, which can also include a flattened lower bottom area, lying within the radiused area generally indicated at 35 and 39. The raised rib 4 lies just outside the front edge of flange 34. This not only assures that the rotor 20 is positively held and retained within the base 12, so that it can rotate easily, but the flange 34 provides a seal between the rotor and base both with respect to its bottom surface and the flattened surface 46 on the rotor and also because of the close positioning between the outer edge of flange 34 and rib 48. Additionally, the composite peripheral edge structure of the rotor also helps maintain the flat, planar configuration of the rotor which is important with respect to maintaining a proper seal between rotor 20 and the planar surface 36 of the base.

The inner fitting relationship between the rotor and the base assures that a proper seal is maintained, so material in the container will not flow between the rotor and base. In an effort to further improve the seal between the rotor and the base, ribs can be added to the bottom of the base.

As shown in FIG. 8, the rotatable lid portion 20 includes a substantially semicircular shaped opening or cutout 58 having an arched edge 60, two straight edges 62 and a small curved edge 64 separating straight edges 62. The opening 58, as will become more apparent below, corresponds to the shape of an openable lid portion 66 of the base 12. When the lid portion 66 is opened, it creates a semicircular shaped opening 68 configured similarly to the cutout 58 of the rotatable lid portion 20. When the rotatable lid portion 20 is rotated the cutout 58 may be selectively aligned with the openable lid portion 66 and opening 68 to thereby provide access to the container contents. Similarly, the rotatable lid portion 20 can be rotated so the cutout 58 is not directly aligned with the opening 68 to either vary the size of the opening 68 or to completely close the opening, thus sealing the container.

Figure 10:
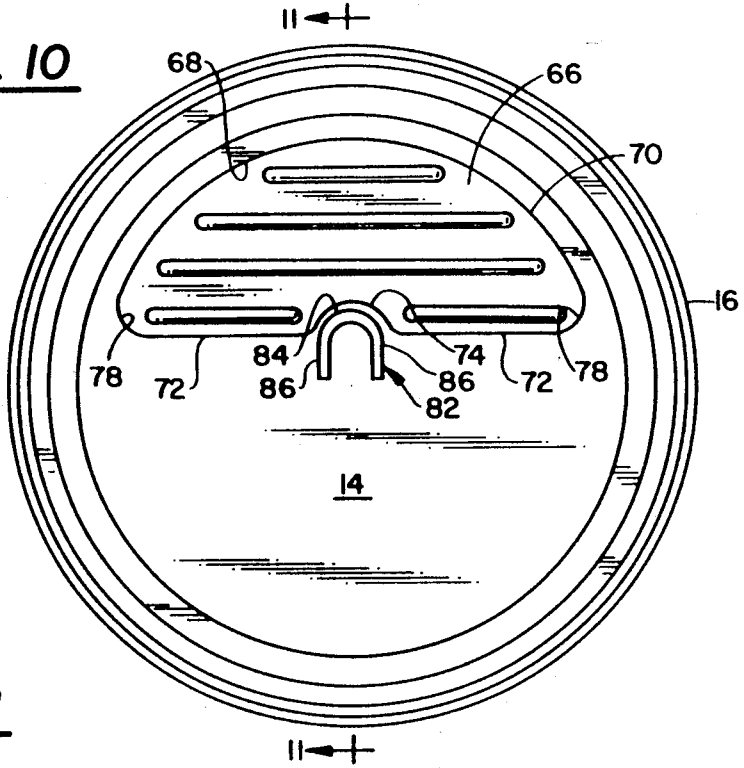
FIG. 10 is a bottom plan view of an end closure provided in accordance with the present invention.

Referring to FIG. 10, openable lid portion 66, provided in accordance with the present invention, can be seen. As with conventional lids of this type, when this lid portion 66 is opened, it will produce a pour opening. Initially, however, all edges of this lid portion 66 are sealed to hermetically seal the container. Because the planar central portion 14 is initially a solid member any tampering of the closure or any attempt to get into the container on which the lid is mounted will result in displacement of the openable lid portion 66. Since any such breach of the sealed edges about portion 66 cannot be repaired, tampering with the closure will be evident. Also, removal of the rotatable lid portion 20 will not open the closure.

Figure 13:
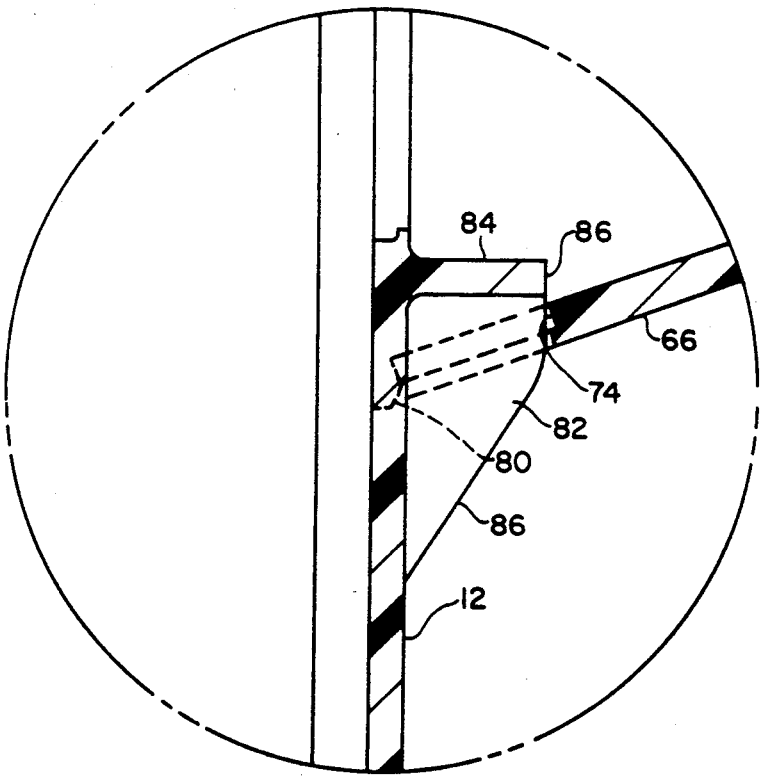
FIG. 13 is an enlarged view of the portion enclosed by the circle 13 in FIG. 12.

The openable lid portion 66 is defined by curved edge 70, straight edges 72 and arched edge 74 which interconnects the straight edges 72. The connection between the base 12 and the curved edge 70 and arched edges 74 is comprised of a solid yet frangible membrane seal 76. The planar portion 14 of base 12 and lid 66 have a thickness of about 0.033 inches. The frangible membrane 76 has a thickness of about $0.003 \pm 0.001$ inches. The connection, shown at 78, between base 12 and edge 72 is not frangible but its thickness of about $0.012 \pm 0.002$ inches allows that connection 78 to operate as a living hinge connection 80 for lid 66, as shown in FIGS. 11 and 13. Consequently, even after the lid portion 66 has been opened, it will not fall into the container but will remain a part of the base 12. As mentioned above, the arched edge 74 and curved edge 70 of the lid portion 66, as shown in drawing FIG. 10, initially constitute a frangible seal so that prior to opening a safe and secure seal is provided to retain and protect the container contents therewithin but which, with manual force from the top of the container, can be broken so as to pivot the openable lid portion 66 about the hinge 80.

Figure 12:
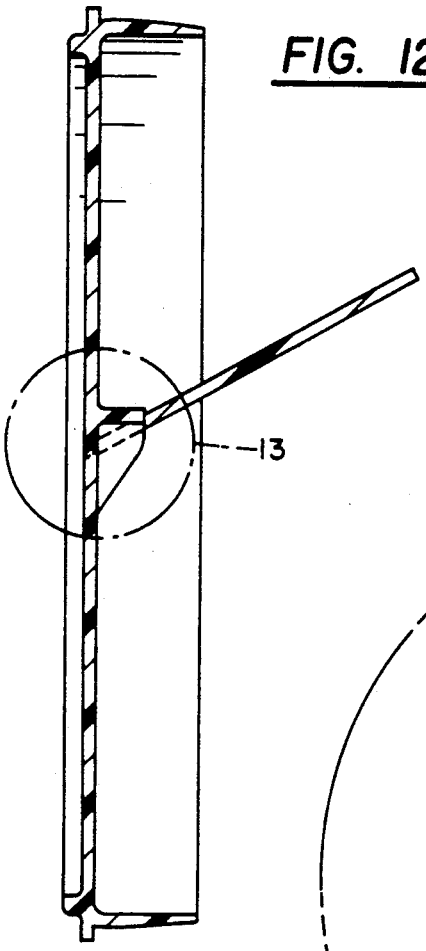
FIG. 12 is a cross-sectional view taken along the line 12—12 in FIG. 8, with the rotor removed.

The living hinge 80, defined between the openable lid portion 66 and the remainder of the container closure 12, exhibits a degree of resiliency and thus, after the openable lid portion 66 is opened it will tend to be disposed at an angle relative to the plane of the base 12, as shown in FIG. 12. Then, if the container is inverted or shaken to remove some material from within the same, the material can contact the angularly disposed openable lid portion 66 and push the lid into a closed or semi-closed condition. Thus, the openable lid portion 66 can disadvantageously interfere with removing contents from the container.

To avoid such interference, in accordance with the present invention, an engaging member, generally indicated at 82, is provided on the bottom surface of the base 12. As shown in FIGS. 10 and 13, the engaging member 82 preferably has a substantially U-shaped configuration having an arced wall 84 extending from the base 12 toward the interior of the container. The wall 84 is coupled to walls 86 also affixed to the base 12, thus forming the engaging member 82. An edge 86 is formed at the end of the curved wall 84.

Thus, as shown in FIG. 13, as the openable lid portion 66 is pivoted to its open position, the arched edge 74 and curved edge 70, which are frangible, break from the base 12. Edge 74 is moved past curved wall 84, until it is latched with edge 86, whereby the openable lid portion is retained in an open disposition. If desired, the openable lid portion 66 can be released from the engaging member 82 by applying a force tending to pivot it about its living hinge 80 towards the closed disposition. However, absent such a positive manual force, the openable lid portion 66 will be retained in its open configuration and will not be "unlocked" by dispensing powdered material and the like from within the container, even if the container is inverted and shaken.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. An end closure for a container comprising:

a substantially planar first lid portion including means for engaging an upper rim of a container to be closed;

a second substantially planar lid portion rotatably mounted to an upper surface of said first lid portion, said second lid portion having an opening defined therethrough, and an openable lid portion defined in said first lid portion, said openable lid portion including a flexible hinge extending along first and second edge portions thereof and a frangible coupling extending along the remaining edges thereof including an edge segment which extends between and interconnects said first and second edge portions of said flexible hinge, a bottom surface of said first lid portion including engaging means for engaging an inner free edge of said openable lid portion defined by said frangible edge segment, so that when force is applied to said openable lid portion said frangible coupling is broken and said openable lid portion pivots about said first and second edge portions, said inner free edge engages said engaging means so as to retain said openable lid portion in an open disposition.

2. An end closure as in claim 1, wherein said opening defined through said second lid portion is substantially semicircular in shape.

3. An end closure as in claim 1, wherein said openable lid portion is of substantially semicircular shape, said frangible coupling defined along an arc of said semicircular openable lid portion, said first and second hinge edge portions defined along straight edge portions of said substantially semicircular openable lid portion.

4. An end closure as in claim 1, wherein said hinge is defined in two equal portions, said engaging means is disposed on said bottom surface of said first lid portion between said two equal portions and includes a wall member extending from said bottom surface into an interior of an attached container, said wall defining a ledge, said inner free edge engaging said ledge so to retain said openable lid portion in an open disposition.

5. An end closure as in claim 4, wherein said engaging means includes a curved wall and second end walls so as to be substantially U-shaped in horizontal cross-section.

6. An end closure for a container comprising:

a substantially planar lid portion including means for engaging an upper rim of a container to be closed;

an openable lid portion defined in said lid portion, said openable lid portion including a flexible hinge extending along first and second edge portions thereof and a frangible coupling extending along the remaining edges thereof including an edge segment which extends between and interconnects said first and second edge portions of said flexible hinge, a bottom surface of said lid portion including engaging means for engaging an inner free edge of said openable lid portion defined by said frangible edge segment, so that when force is applied to said openable lid portion said frangible coupling is broken and said openable lid portion pivots about said first and second edge portions, said inner free edge engages said engaging means so as to retain said openable lid portion in an open disposition.

7. An end closure as in claim 6, wherein said openable lid portion is of substantially semicircular shape, said frangible coupling defined along an arc of said semicircular openable lid portion, said first and second hinge edge portions defined along straight edge portions of said substantially semicircular openable lid portion.

8. An end closure as in claim 6, wherein said hinge is defined in two equal portions, said engaging means is disposed on said bottom surface of said lid portion between said two equal portions and includes a wall member extending from said bottom surface, said wall defining a ledge, said inner free edge engaging said ledge so to retain said openable lid portion in an open disposition.

9. An end closure as in claim 8, wherein said engaging means includes a curved wall and second end walls so as to be substantially U-shaped in horizontal cross-section.

* * * * *